US007322888B2

(12) United States Patent
Singhaseni

(10) Patent No.: US 7,322,888 B2
(45) Date of Patent: Jan. 29, 2008

(54) METHOD FOR PLAYER-INFLUENCED RANDOM DISTRIBUTION OF GAME TOKENS

(76) Inventor: Lertyos Singhaseni, 6727 Rudnick Ave., Woodland Hills, CA (US) 91303

( * ) Notice: Subject to any disclaimer, the term of this patent is extended or adjusted under 35 U.S.C. 154(b) by 697 days.

(21) Appl. No.: 10/686,381

(22) Filed: Oct. 14, 2003

(65) Prior Publication Data

US 2005/0079909 A1 Apr. 14, 2005

(51) Int. Cl.
*A63F 9/24* (2006.01)

(52) U.S. Cl. ..... 463/22; 463/16

(58) Field of Classification Search ..... 463/22, 463/19, 16–20; 380/44; 273/274, 146, 309
See application file for complete search history.

(56) References Cited

U.S. PATENT DOCUMENTS 3,859,635 A * 1/1975 Watson et al. ..... 708/130
4,588,193 A 5/1986 Winston
4,713,787 A * 12/1987 Rapp ..... 463/22
4,926,327 A 5/1990 Sidley
5,251,165 A * 10/1993 James, III ..... 708/250
5,445,391 A 8/1995 Gleaston, Jr.
5,718,432 A 2/1998 Fraser
5,791,652 A 8/1998 Nielsen
5,882,260 A 3/1999 Marks et al.
5,888,136 A * 3/1999 Herbert ..... 463/22
6,030,288 A 2/2000 Davis et al.
6,099,408 A * 8/2000 Schneier et al. ..... 463/29
6,164,651 A 12/2000 Webb
6,165,072 A * 12/2000 Davis et al. ..... 463/29
6,248,016 B1 * 6/2001 Walker et al. ..... 463/13
6,386,973 B1 * 5/2002 Yoseloff ..... 463/13
6,478,676 B1 11/2002 Dayan
6,728,740 B2 * 4/2004 Kelly et al. ..... 708/250
2003/0199294 A1 * 10/2003 Walker et al. ..... 463/13

* cited by examiner

*Primary Examiner*—Robert E Pezzuto
(74) *Attorney, Agent, or Firm*—Denton L. Anderson; Sheldon Mak Rose & Anderson PC

(57) ABSTRACT

A method for distributing game tokens, such as playing cards, in a game which includes the distribution of game tokens to n players ($P_1$, $P_2$, . . . $P_n$), includes the steps of: (a) obtaining from each player $P_i$ a first unit $A_i$, wherein each $A_i$ is chosen from a finite set of discrete candidate first units; (b) obtaining from each player $P_i$ a second unit $B_i$, wherein each $B_i$ is chosen from a finite set of discrete candidate second units; (c) deriving a third unit C using a predetermined algorithm where $C=f(B_1, \ldots, B_n)$; (d) assigning a previously unassigned game token $G_i$ to each player from a predetermined algorithm where $G_i=f(A_i, C)$; and (e) repeating steps (a)-(d) until a predetermined number of game tokens cards are distributed to each player.

16 Claims, 1 Drawing Sheet

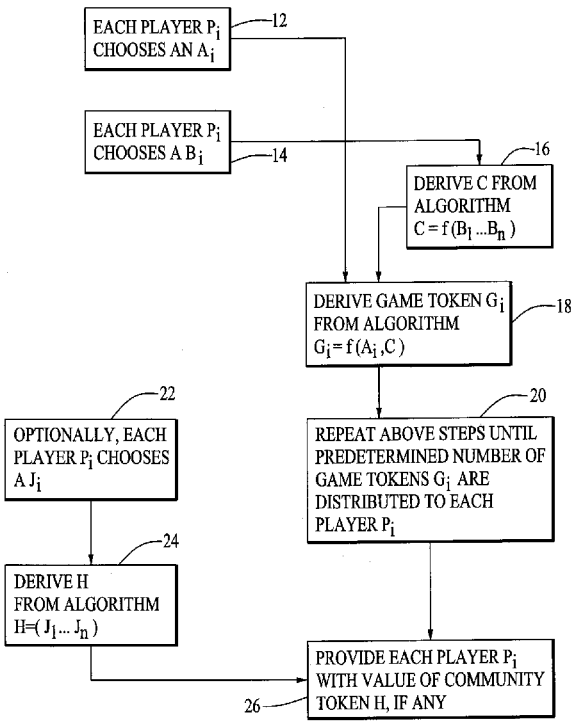

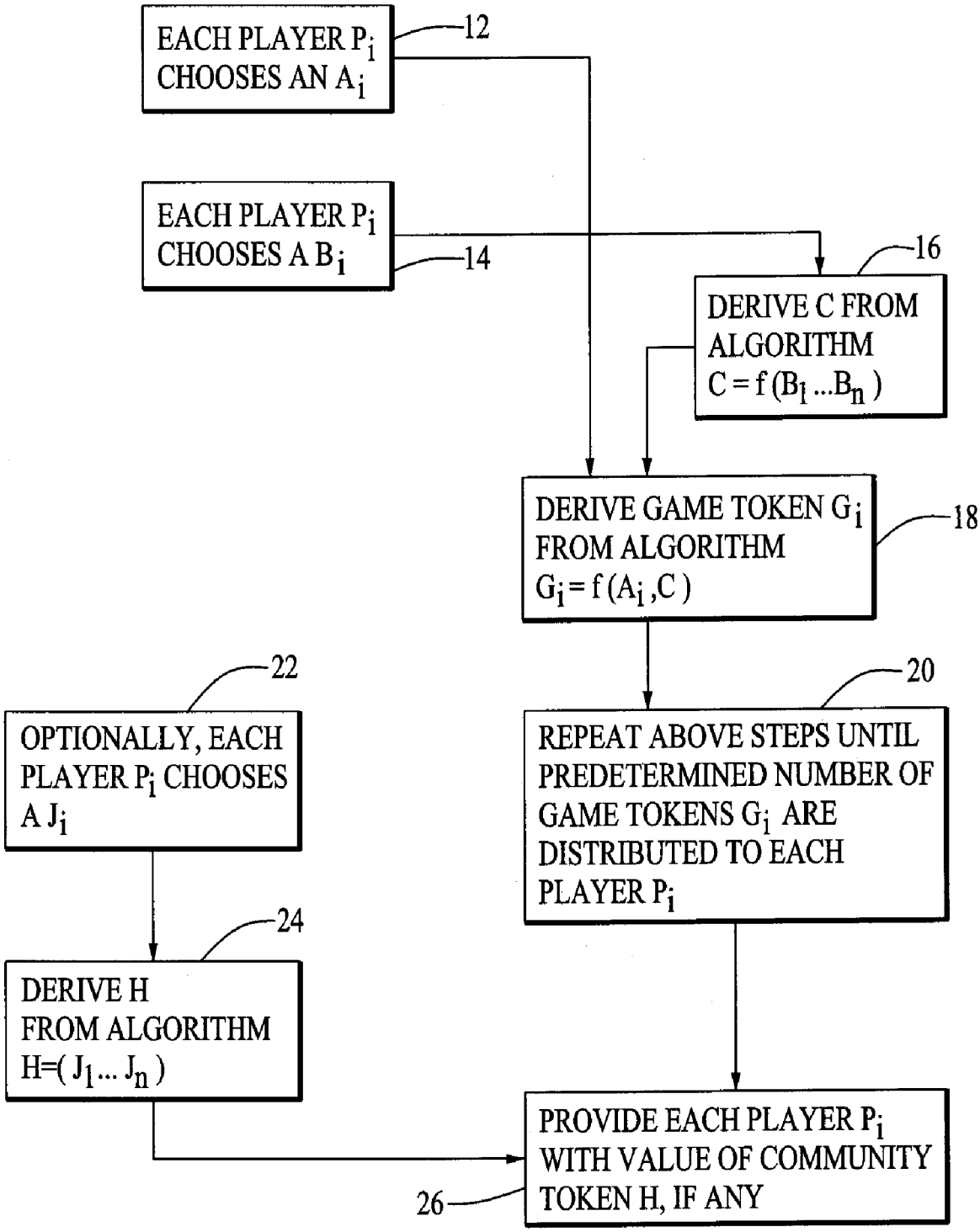
EACH PLAYER $P_i$ CHOOSES AN $A_i$
12
EACH PLAYER $P_i$ CHOOSES A $B_i$
14
16
DERIVE C FROM ALGORITHM $C = f(B_1 \ldots B_n)$
DERIVE GAME TOKEN $G_i$ FROM ALGORITHM $G_i = f(A_i, C)$
18
22
20
OPTIONALLY, EACH PLAYER $P_i$ CHOOSES A $J_i$
REPEAT ABOVE STEPS UNTIL PREDETERMINED NUMBER OF GAME TOKENS $G_i$ ARE DISTRIBUTED TO EACH PLAYER $P_i$
24
DERIVE H FROM ALGORITHM $H=(J_1 \ldots J_n)$
PROVIDE EACH PLAYER $P_i$ WITH VALUE OF COMMUNITY TOKEN H, IF ANY
26

METHOD FOR PLAYER-INFLUENCED RANDOM DISTRIBUTION OF GAME TOKENS

FIELD OF THE INVENTION

This invention relates generally to the distribution of game tokens in a game having multiple players. It relates more specifically, to the random distribution of such game tokens.

BACKGROUND OF THE INVENTION

The random distribution of game tokens, such as the random distribution of playing cards in a card game has been known for many centuries. Prior to the introduction of digital computer games, the most common method of randomly distributing game tokens comprised the step of physically shuffling the tokens prior to the distribution of those tokens. In games played using digital computers, game tokens are typically randomly distributed using software—akin to a random number generator.

The problem with all known prior art methods of randomly distributing game tokens is that the individual players have no way of knowing whether the distribution of the game tokens has been conducted by a truly random method. Mechanical methods, such as shuffling of a deck of cards, has always been susceptible to cheating by fast fingered card sharks. With respect to games operated using a digital computer, the players cannot be sure that the random token generator has not been intentionally skewed to favor one player or another. This is an especially important problem with respect to computer operated games played on the internet.

Accordingly, there is a need for a method for the random distribution of game tokens where each player can be assured that the distribution of tokens is purely random.

SUMMARY

The invention satisfied this need. The invention is a method for distributing game tokens to players in a game wherein the game comprises the distribution of game tokens to n players ($P_1, P_2, \ldots P_n$), where n is greater than 1. The method comprises the steps of: (a) obtaining from each player $P_i$ a first unit $A_i$, wherein each $A_i$ is chosen from a finite set of discrete candidate first units; (b) obtaining from each player $P_i$ a second unit $B_i$, wherein each $B_i$ is chosen from a finite set of discrete candidate second units; (c) deriving a third unit C using a predetermined algorithm where $C=f(B_1, \ldots, B_n)$; (d) assigning a previously unassigned game token $G_i$ to each player from a predetermined algorithm where $G_i=f(A_i, C)$; and (e) repeating steps (a)-(d) until a predetermined number of game tokens are distributed to each player.

DRAWINGS

These and other features, aspects and advantages of the present invention will become better understood with reference to the following description, appended claims and accompanying drawing, which is a logic flow diagram illustrating the method of the invention.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a method of distributing game tokens to players in a game wherein the game comprises a distribution of game tokens to n players, $P_1, P_2, \ldots P_n$, where n is greater than 1. The method can be applied to card games where the game tokens are playing cards. The method can also be applied to dominos where the game tokens are the individual dominos and to many other games where game tokens are randomly distributed to players in the game.

Referring to the drawing, the method comprises the steps of: (a) obtaining from each player $P_i$ a first unit $A_i$, wherein each $A_i$ is chosen from a finite set of discrete candidate first units (step 12 in the drawing); (b) obtaining from each player $P_i$ a second unit $B_i$, wherein each $B_i$ is chosen from a finite set of discrete candidate second units (step 14 in the drawing); (c) deriving a third unit C using a predetermined algorithm where $C=f(B_i, \ldots, B_n)$ (step 16 in the drawing); (d) assigning a previously unassigned game token $G_i$ to each player from a predetermined algorithm where $G_i=f(A_i, C)$ (step 18 in the drawing); and (e) repeating steps (a)–(d) until a predetermined number of game tokens are distributed to each player (step 20 in the drawing). The term "algorithm" as used in this application is meant to denote a set of rules for determining the identity of a particular parameter. The rules can include a single mathematical formula, a series of formulae and/or one or more predetermined processing steps.

In one embodiment of the invention wherein the game is a card game played with a standard 52 card deck of playing cards, the finite, set of discrete candidate first units is typically 52 in number. In one such embodiment of the invention, each first unit $A_i$ is an integer between 1 and 52. In another such embodiment, each first unit $A_i$ is a playing card from the deck of 52 playing cards.

Each player chooses a first unit $A_i$ in turn, until each of the players has chosen an $A_i$ in that round. Each player also chooses a second unit $B_i$ in turn, until each of the players has chosen an $B_i$ in that round.

After each second unit $B_i$ is chosen in a given round, the third unit C is determined from a predetermined algorithm where $C=f(B_1, \ldots B_n)$, C being wholly a function of the second units. In one typical embodiment of the invention, each $B_i$ is an integer and $C=\Sigma B_i$, that is, C is the sum of each of the several second units.

After the third unit C has been determined, a game token $G_i$ is assigned to each player from a predetermined algorithm where $G_i=f(A_i, C)$, each. $G_i$ being wholly a function of $A_i$ and C. In one example, where $A_i$ and $B_i$ are integers, the predetermined algorithm can comprise the steps of adding $A_i$ to C and then repeatedly subtracting from that result the total of the number of candidate first unit until the new result is an integer between 1 and the total number of candidate first units. Game tokens $G_i$ are then assigned to the players by reference to a predetermined matrix which relates each $G_i$ with a unique game token. If the game token to be assigned to a player has already been assigned in the game, a substitute game token is assigned to that player by a predetermined rule or set of rules, such as, by a rule which assigns to such a player the next token in sequence within the matrix.

The above-described steps are repeated round after round until a predetermined number of game tokens are distributed to each player. In one embodiment of the invention, applicable especially to certain poker games, the method can further comprise the steps of, after the predetermined number of tokens are distributed to each player, a community token H, useable by all players, is chosen by obtaining from each player $P_i$ a new unit $J_i$(step 22 in the drawing) and determining the community token H by a predetermined algorithm where $H=f(J_i, \ldots, J_n)$, H being wholly a function of the new units $J_i$ (steps 24 and 26 in the drawing). The method is ideally employed using a digital computer to store the various algorithms, calculate the various parameters and assign each game token. Nondigital computing devices can also be used to assist in carrying out the method.

EXAMPLES

Example 1

In a first example of the invention, the method is used to distribute cards to two players engaged in a card game requiring the distribution of one card to each player in each round, until five cards are dealt to each player.

The first units $A_i$, are chosen from integers between 1 and 52. Each second unit, $B_i$ is chosen from a set of integers between 1 and 100. The algorithm for determining the third unit C is as follows: $C=\Sigma B_i$.

The algorithm for assigning cards $G_i$ as a function of first units $A_i$ and C is as follows: each player's first unit is added to C to yield an intermediate value $I_i$, i.e., $I_i=A_i+C$. Thereafter, if $I_i$ is within the range 1-52, the card assigned to the player $P_i$ is chosen from a matrix in which each card is assigned a unique number between 1 and 52. If $I_i$ is greater than 52, the number 52 is repeatedly subtracted from $I_i$ until a value is obtained which is within the range 1-52. That value is used to assign a card to player $P_i$ using the matrix.

After a card is assigned to each player in the first round, the method is repeated four times, whereupon each player is assigned five cards.

Example 2

In a second example, all the rules are the same as for the first example, except that the first units $A_i$ are chosen from the 52 cards in a standard deck of cards. After each player has chosen a card as his or her $A_i$, each player is assigned an integer corresponding to that card, the integer being assigned using the same matrix which assigns cards $G_i$. After each player is assigned an integer corresponding to his or choice for $A_i$, that integer is used in the assignment of a card $G_i$ by the same algorithm that is used in the first example.

Having thus described the invention, it should be apparent that numerous structural modifications and adaptations may be resorted to without departing from the scope and fair meaning of the instant invention as set forth hereinabove.

What is claimed is:

1. A method of distributing game tokens to players in a game wherein the game comprises the distribution of game tokens to n players, $P_1, P_2, \ldots P_n$, where n is greater than 1, the method comprising the steps of:

(a) obtaining from each player $P_i$ a first unit $A_i$, wherein each $A_i$ is chosen from a finite set of discrete candidate first units;

(b) obtaining from each player $P_i$ a second unit $B_i$, wherein each $B_i$ is chosen from a finite set of discrete candidate second units;

(c) deriving a third unit C using a predetermined algorithm where $C=f(B_1, \ldots, B_n)$;

(d) assigning a previously unassigned game token $G_i$ to each player from a predetermined algorithm where $G_i=f(A_i, C)$; and (e) repeating steps (a)-(d) until a predetermined number of game tokens cards are distributed to each player.

2. The method of claim 1 wherein the game tokens are playing cards.

3. The method of claim 1 wherein the first units are playing cards.

4. The method of claim 1 wherein the second units are integers.

5. The method of claim 4 wherein $C=\Sigma B_i$.

6. The method of claim 1 further comprising the steps of, after the predetermined number of game tokens are distributed in step (e), a community token H is chosen by obtaining from each player $P_i$ a new unit $J_i$ and determining the community token H by a predetermined algorithm $H=f(J_1, \ldots, J_n)$.

7. The method of claim 1 wherein each $A_i$ obtained from step (a) and each $B_i$ obtained from step (b) is inputted into a computer and the computer derives C in step (c) and each assigned game token $G_i$ in step (d).

8. The method of claim 7 wherein the computer is a digital computer.

9. A method of distributing playing cards to players in a game wherein the game comprises the distribution of playing cards to n players, $P_i, P_2, \ldots, P_n$, wherein n is greater than 1, the method comprising the steps of:

(a) providing a digital computer;

(b) entering into the computer a first unit $A_i$, where each $A_i$, is chosen from a finite set of discrete candidate first units;

(c) entering into the computer a second unit $B_i$, wherein each $B_i$ is chosen from a finite set of discrete candidates second unit;

(d) deriving, using the computer, a constant C from a predetermined algorithm where $C=f(B_i, \ldots, B_n)$;

(e) using the computer, assigning a previously unassigned card $G_i$ to each player from a predetermined algorithm where $G_i=f(A_i, C)$; and (f) repeating steps (b)-(e) until a predetermined number of playing cards are distributed to each player.

10. The method of claim 9 wherein the first units are playing cards.

11. The method of claim 9 wherein the second units are integers.

12. The method of claim 11 wherein $C=\Sigma B_i$.

13. The method of claim 9 further comprising the steps of, after the predetermined number of playing cards are distributed in step (f), a community playing card H is chosen by obtaining from each player $P_i$ a new unit $J_i$ and, using the computer, determining the community playing card H by a predetermined algorithm where $H=f(J_i, \ldots, J_n)$.

14. A method of distributing playing cards to players in a game wherein the game comprises the distribution of playing cards to n players, $P_i, P_2, \ldots, P_n$, wherein n is greater than 1, the method comprising the steps of:

(a) providing a digital computer;

(b) entering into the computer a first unit $A_i$, where each $A_i$, is chosen from a finite set of discrete candidate first units;

(c) entering into the computer a second unit $B_i$, wherein each $B_i$ is an integer chosen from a finite set of discrete candidate integers;

(d) deriving, using the computer, a constant C from a predetermined algorithm where $C=f(B_i, \ldots, B_n)$;

(e) using the computer, assigning a previously unassigned card $G_i$ to each player from a predetermined algorithm where $G_i=f(A_i, C)$;

(f) repeating steps (b)-(e) until a predetermined number of playing cards are distributed to each player; and (g) choosing a community card H after the predetermined number of playing cards are distributed in step (f), a community of playing card H is chosen by obtaining from each player $P_i$a new unit $J_i$ and, using the computer, determining the community playing card H by a predetermined algorithm where $H=f(J_1, \ldots, J_i)$.

15. The method of claim 14 wherein the first units are playing cards.

16. The method of claim 14 wherein $C=\Sigma B_i$.

* * * * *